US009630083B2

(12) United States Patent
McCrane

(10) Patent No.: US 9,630,083 B2
(45) Date of Patent: Apr. 25, 2017

(54) MOLDED GRIP GLOVE

(75) Inventor: David Patrick McCrane, Napa, CA (US)

(73) Assignee: Implus Footcare, LLC, Durham, NC (US)

( * ) Notice: Subject to any disclaimer, the term of this patent is extended or adjusted under 35 U.S.C. 154(b) by 1564 days.

(21) Appl. No.: 12/842,362

(22) Filed: Jul. 23, 2010

(65) Prior Publication Data

US 2012/0017349 A1 Jan. 26, 2012

(51) Int. Cl.

| | |
|---|---|
| ***A41D 19/00*** | (2006.01) |
| ***A63B 71/14*** | (2006.01) |
| ***A63B 21/00*** | (2006.01) |
| *A63B 21/06* | (2006.01) |

(52) U.S. Cl.

CPC ..... *A63B 71/141* (2013.01); *A63B 21/4019* (2015.10); *A63B 21/06* (2013.01)

(58) Field of Classification Search

CPC .... A63B 71/141; A63B 21/4019; A63B 21/06
USPC ..... 2/20, 21, 159, 160, 161.1–161.8, 163, 2/167

See application file for complete search history.

(56) References Cited

U.S. PATENT DOCUMENTS

| | | | | | |
|---|---|---|---|---|---|
| 325,968 | A | * | 9/1885 | Rawlings | 2/19 |
| 745,088 | A | * | 11/1903 | Winkler | 2/163 |
| 2,258,999 | A | * | 10/1941 | Nunn | 2/159 |
| 2,670,736 | A | * | 3/1954 | Dunkelberger | 128/844 |
| 3,164,841 | A | * | 1/1965 | Burtoff | 2/21 |
| 4,691,387 | A | | 9/1987 | Lopez | |
| 4,793,005 | A | | 12/1988 | Hetzel, Jr. | |
| 5,069,454 | A | | 12/1991 | Frost | |
| 5,180,165 | A | | 1/1993 | Frost | |
| 5,182,814 | A | | 2/1993 | Christensen | |
| 5,557,806 | A | | 9/1996 | Caswell et al. | |
| 5,581,809 | A | | 12/1996 | Mah | |
| 5,604,934 | A | * | 2/1997 | Willett | 2/161.1 |
| 5,715,539 | A | | 2/1998 | Benecki et al. | |

(Continued)

*Primary Examiner* — Salley Haden
(74) *Attorney, Agent, or Firm* — Edward S. Wright

(57) ABSTRACT

Glove for use in weightlifting or other activities in which an object is gripped. The glove has pads of moldable, malleable, substantially cohesive material on the palm and fingers that conforms to the contours of the object and a hand wearing the glove and retains its shape without hardening to provide a firm, solid grip between the hand and the object. The palm section and the finger stalls are fabricated of thin, flexible material, and the pads overlie fleshier parts of the palm and fingers, with gaps between the pads extending along joint lines of the palm and fingers and the elastic material in the gaps providing hinges which flex along the joint lines and allow adjacent ones of the pads to come together to form a substantially continuous gripping surface when the hand and glove are curled about the object. The malleable material in the pads on the finger stalls is enclosed in pockets having rolled upper edges, with front and rear panels which are formed continuously with the rolled edges and fastened together along side and bottom edges of the pockets. In some embodiments, the pads are attached directly to the body of the glove and to the finger stalls, and in others they are attached to an outer layer that overlies the palm section and further facilitates gripping of the object.

28 Claims, 3 Drawing Sheets

(56) References Cited

U.S. PATENT DOCUMENTS

| | | | | |
|---|---|---|---|---|
| 6,119,271 | A * | 9/2000 | Byon | 2/161.2 |
| 6,216,276 | B1 | 4/2001 | Eibert | |
| 6,509,385 | B2 | 1/2003 | Sereboff | |
| 6,691,321 | B1 | 2/2004 | Matut | |
| 6,704,939 | B2 | 3/2004 | Faulconer | |
| 6,721,960 | B1 * | 4/2004 | Levesque et al. | 2/161.1 |
| 6,745,402 | B2 | 6/2004 | Caswell | |
| 6,832,391 | B1 | 12/2004 | Bower | |
| 6,898,802 | B1 | 5/2005 | Suarkeo | |
| 2003/0051285 | A1 | 3/2003 | Bower | |
| 2003/0139258 | A1 * | 7/2003 | Riggall | 482/49 |
| 2004/0006814 | A1 | 1/2004 | Holden | |
| 2004/0237165 | A1 | 12/2004 | Holden | |
| 2005/0210562 | A1 * | 9/2005 | Johnson et al. | 2/159 |
| 2006/0195968 | A1 | 9/2006 | Powell et al. | |
| 2007/0105977 | A1 * | 5/2007 | Gabriel et al. | 523/122 |
| 2007/0150999 | A1 * | 7/2007 | Brown | 2/159 |
| 2008/0271224 | A1 | 11/2008 | Wilbert et al. | |
| 2009/0100573 | A1 | 4/2009 | Coulter et al. | |
| 2009/0288236 | A1 | 11/2009 | Hawkes | |
| 2010/0043113 | A1 | 2/2010 | Clark et al. | |
| 2012/0011633 | A1 * | 1/2012 | Van Hale | 2/20 |
| 2012/0017351 | A1 * | 1/2012 | McCrane | 2/161.1 |

* cited by examiner

Fig. 4
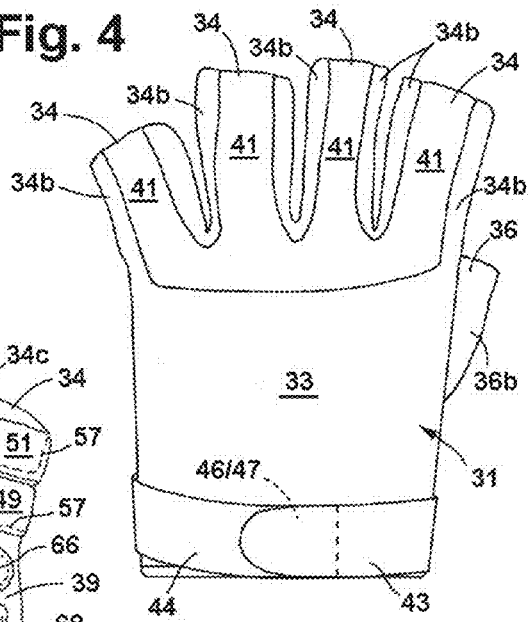
Fig. 3
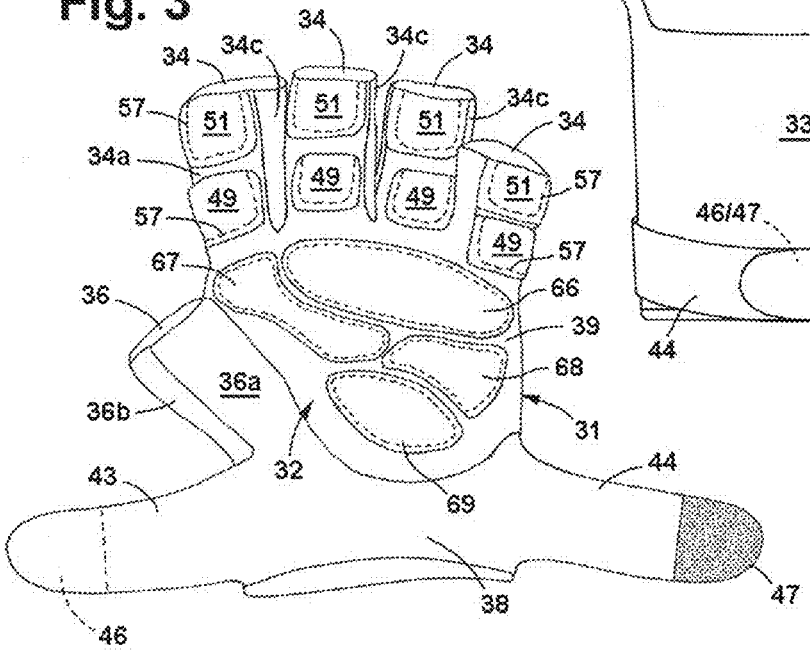
Fig. 5
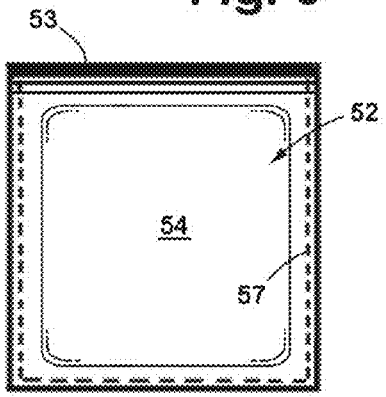
Fig. 6
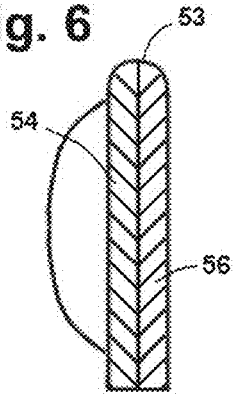
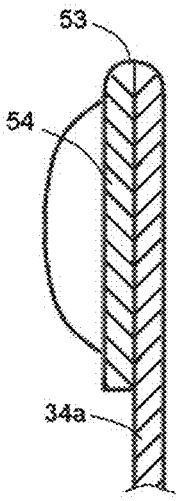
Fig. 6A Fig. 7
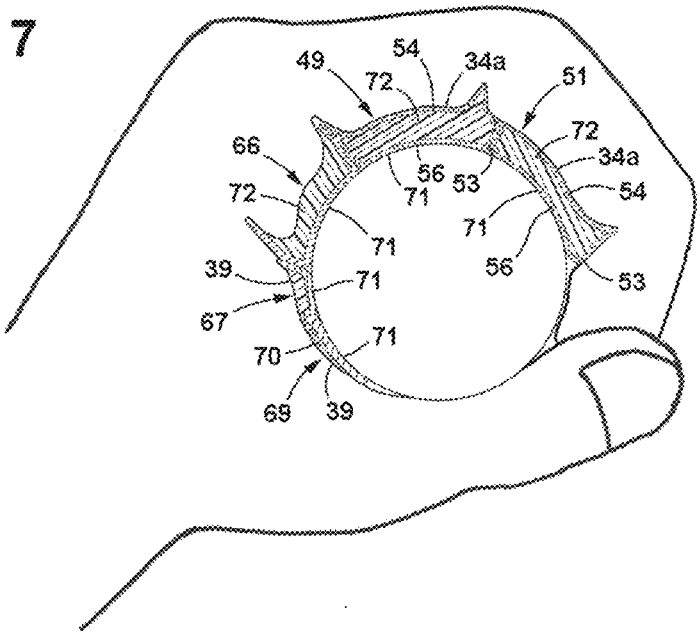
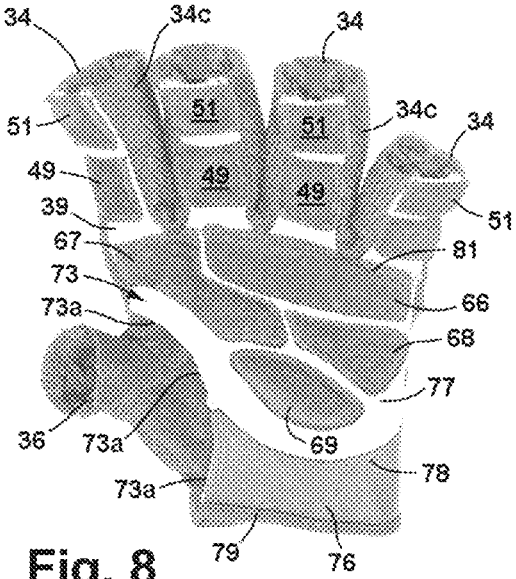
Fig. 8
Fig. 9
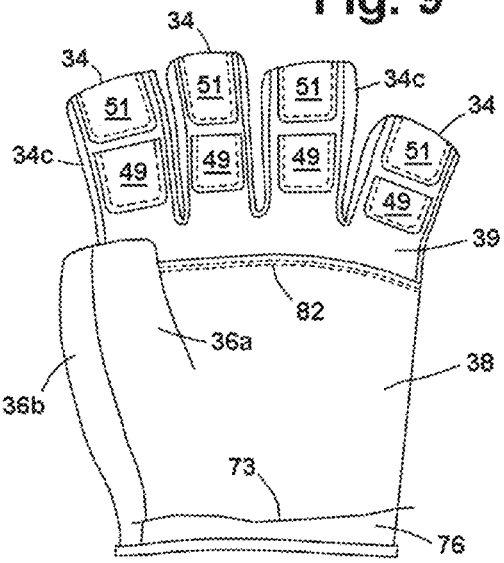

MOLDED GRIP GLOVE

BACKGROUND OF THE INVENTION

Field of Invention

This invention pertains generally to gloves and, more particularly, to a glove for use by a person engaging in an activity such as weightlifting and other activities in which a person grips an object.

Related Art

People engaging in activities such as weightlifting, where the grip on an object is important, commonly use gloves to protect their hands and to get a better grip on the object. Gloves heretofore provided for such use often have pads on the palm and/or fingers which are intended to improve the grip and/or prevent slippage as well as protecting the hand. However, such pads are often in the wrong places and can actually make it more difficult for a person to close his hand about the object to get and maintain a firm grip. Moreover, padding on the palm can cause the palm portion of the glove to bunch up as the hand curls about the object, making it even more difficult to get a good grip.

The anatomy of the human hand is such that when the hand is curled about a cylindrical object, only the fleshier parts of the palm and fingers actually engage the object. Thus, as illustrated in FIG. 1, when the hand grips an object 11 such as a weightlifting bar, the parts of the hand that engage the object are the lower part or base 12 of the palm, the upper part 13 of the palm, the lower sections 14 of the fingers, the middle sections 16 of the fingers, and the outer or tip sections 17 of the fingers. Between these fleshier parts, there are substantial voids or gaps where there is no contact with the object. The gaps correspond to the fold lines or joints of the hand and include gap 19 along the transverse fold lines 21, 22 of between the upper and lower sections of the palm, gap 23 along the joint lines 24 between the upper section of the palm and the base of the fingers, gap 26 along the joint lines 27 between the lower finger and middle finger sections, and gap 28 along the joint lines 29 between middle and tip sections of the fingers. These gaps compound the problem of getting a firm grip on the object while wearing gloves.

OBJECTS AND SUMMARY OF THE INVENTION

It is, in general, an object of the invention to provide a new and improved glove for use in weightlifting and other activities in which an object gripped.

Another object of the invention is to provide a glove of the above character which overcomes the limitations and disadvantages of gloves heretofore provided.

These and other objects are achieved in accordance with the invention by providing a glove having a palm section, finger stalls extending from the palm section, and pads on the palm section and the finger stalls of malleable, non-compressible material that conforms to the contours of the object and a hand wearing the glove without hardening to provide a firm, solid grip between the hand and the object.

The palm section and the finger stalls are fabricated of a flexible material and the pads overlie fleshier parts of the palm and fingers, with gaps between the pads extending along joint lines of the palm and fingers and the flexible material in the gaps providing hinges which flex along the joint lines and allow adjacent ones of the pads to come together to form a substantially continuous gripping surface when the hand and glove are curled about the object.

The moldable material in the pads on the finger stalls is enclosed in pockets having folded or rolled upper edges, with front and rear panels which are formed continuously with the rolled edges and fastened together along side and bottom edges of the pockets.

In some embodiments, the palm section includes an inner layer which fits over the palm of the hand and an outer layer which is attached to the inner layer near the base of the palm section and near the finger stalls, with the pads on the palm section being attached to the outer layer.

BRIEF DESCRIPTION OF THE DRAWINGS

FIG. 3 is a front elevational view of one embodiment of a glove incorporating the invention.

FIG. 4 is rear elevational view of the embodiment of FIG. 3.

FIG. 5 is an enlarged front elevational view of one of the finger pads employed on the glove in the embodiment of FIG. 3.

FIG. 6 is an enlarged vertical sectional view of the finger pad in the embodiment of FIG. 5.

FIG. 6A is a view similar to FIG. 6 illustrating another way of constructing finger pads for the glove in the embodiment of FIG. 3.

FIG. 7 is a view similar to FIG. 1, illustrating the manner in which glove in the embodiment of FIG. 1 conforms to the contours of both the hand and an object gripped by the hand.

FIG. 8 is a front elevational view of another embodiment of a glove incorporating the invention.

FIG. 9 is front elevational view, partly broken away, of the embodiment of FIG. 8.

DETAILED DESCRIPTION

Figure 1:
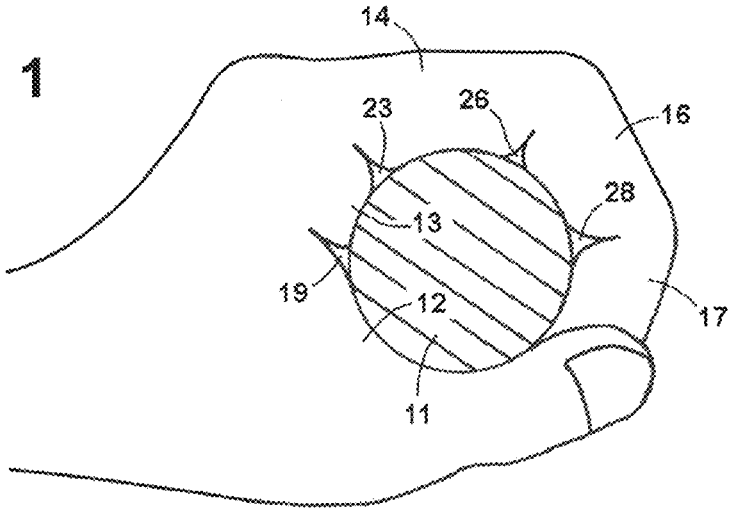
FIG. 1 is a side elevational view, partly in section, of a human hand curled about a cylindrical object such as a weightlifting bar.

As illustrated in FIG. 3, the glove has a body 31 with a palm or front side 32 and a back side 33 which are shaped to conform generally to the palm and to the back of the user's hand. Finger stalls 34 extend from the upper portion of the body, and a thumb stall 36 extends from the front. The palm section has a lower section 38 fabricated of a substantially inelastic material such as leather and an upper section 39 fabricated of a relatively flexible or stretchable material such as a Lycra® fabric or other suitable material. The front portions 34*a* of the finger stalls are fabricated of a thin, flexible material, and the front portion 36*a* of the thumb stall is fabricated of the same substantially inelastic material as the lower portion of the palm section. The back of the glove and the backs and sides of the finger and thumb stalls are fabricated of a stretchable material such as spandex, with leather sections 41 over the stretchable material in various positions on the back of hand and/or on the backs of the finger stalls.

In this embodiment, the glove illustrated as being secured to the hand by a pair of straps 43, 44 which wrap around the back side of the glove below the base of the thumb and are secured together by a Velcro® fastener 46, 47. However, it can be secured in any suitable manner, including a wide strap that wraps about both the base of the palm and the wrist to provide integrated hand and wrist support.

Pads containing a moldable clay-like substance that is substantially non-compressible, reshapable and retains its shape without hardening are provided on the fronts of the finger stalls and on the palm section of the glove to fill in the gaps between the fleshy parts of the fingers and palm and provide a substantially continuous gripping surface for engagement with a cylindrical object about which the hand is curled. The moldable material is preferably one which is also cohesive and non-oozing such that it does not require a liquid-tight bladder to contain it. Being malleable and retaining its shape without hardening, the material readily reshapes to conform to the contours of different hands and different objects.

One suitable substance for use in the pads is a Plasticine® material composed of calcium salts (principally calcium carbonate), petroleum jelly, and long-chain aliphatic acids (principally stearic acid). It is non-compressible, non-toxic, sterile, soft, malleable, and does not harden or dry on exposure to air.

Another material that might be used in the pads is a composition comprising a viscous fluid and a plurality of macroparticulates and/or micropaticulates, as described in U.S. Pat. No. 6,509,385 and marketed under the Sereflex trademark. Such substances may contain a semi-processed fluid or gel for shock absorption and distribution of pressure.

Two pads of the moldable material are provided on each of the finger stalls, with pads 49 positioned to overlie the lower sections of the fingers and pads 51 positioned to overlie the middle sections. Each pad is positioned just lie below the joint between the section on which it is located and the section above it. Thus, pads 49 are positioned to lie just below joint lines 27 between the lower and middle finger sections, and pads 51 are positioned to lie just below joint lines 29 between the middle and tip sections.

In the pads on the finger stalls, the moldable material is contained within pockets 52 with folded or rolled upper edges 53. As illustrated in FIGS. 5 and 6, each pocket consists of a generally rectangular piece of substantially inelastic material such as leather which is folded along its horizontal centerline to form front and rear panels 54, 56 with the rolled edge between them. The two panels are fastened together and attached to the finger stalls by stitching 57 along the sides and lower edges of the pockets, with the rolled upper edges being left unattached or floating for better conformation to the fingers.

Alternatively, as illustrated in FIG. 6A, instead of using separate pieces of material for the pockets near the tips of the finger stalls, the panels that form the front portions 34*a* of the stalls can be extended beyond the tips of the stalls and folded down at the tips to form the rolled edges 53 and the front panels 54 of the pockets. These panels overlie the upper portions of the finger stalls just below the tips and are fastened to the front portions of the stalls along the sides and lower edges of the panels to form the pockets.

The moldable material is cut into pieces of the proper size for each of the pads and placed in the pockets before the front and rear panels are fastened together.

Figure 2:
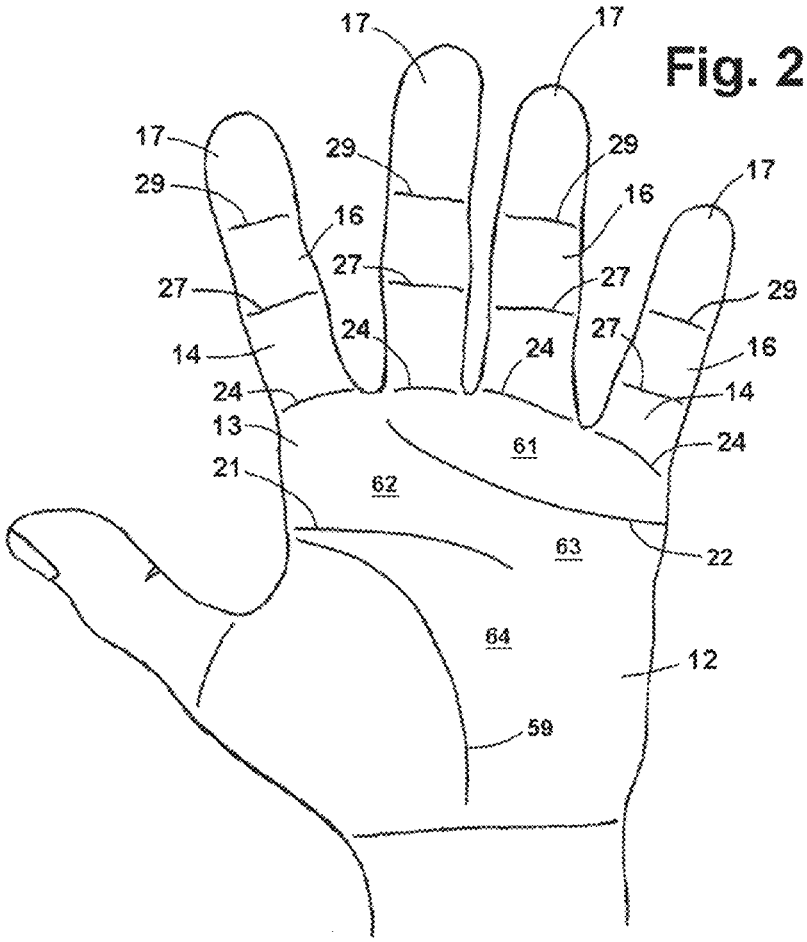
FIG. 2 is an elevational view of the palm side of the hand of FIG. 1 in an uncurled or extended position.

As illustrated in FIG. 2, the palm of the hand typically has four fleshy areas which are separated by transverse fold lines 21, 22, commonly referred to as the head line and the heart line, and by a third line 59, commonly referred to as the life line. Area 61 is located in the upper section of the palm between heart line 22 and the bases of the middle, ring, and little fingers. Area 62 is also located in the upper section of the palm between the base of the forefinger, heart line 22, and head line 21. Area 63 is in the middle section of the palm between heart line 22 and the lower portion of head line 21, and area 64 is located between the lower portion of head line 21 and life line 59.

In the embodiment of FIG. 3, pads are positioned to overlie each of the four fleshy areas of the palm. Pad 66 is configured and positioned to overlie area 61 between heart line 22 and the bases of the middle, ring, and little fingers, pad 67 is configured and positioned to overlie area 62 between the base of the forefinger, heart line 22, and head line 21, pad 68 is configured and positioned to overlie area 63 between heart line 22 and the lower portion of head line 21, and pad 69 is configured and positioned to overlie area 64 between the lower portion of head line 21 and life line 59.

The pads on the upper portion of the palm section include the same moldable, clay-like substance as the pads on the finger stalls. However, since the rolled edge is not needed in those areas, pads 66, 67 consist simply of patches of leather stitched about their peripheries to the thin, stretchable material in the palm section, with the moldable material being inserted between the two layers before they are sewn together.

In this particular embodiment, the pads 68, 69 on the middle and lower portions of the palm are filled with a resilient foam material. If desired, these pads could be filled with the moldable material instead of the foam, but the moldable material is generally not needed in these areas for weightlifting. These pads are constructed by placing leather patches over the foam material in the areas where they go and attaching them to the material in the palm section by stitching about the peripheries of the patches.

The pads on the finger stalls and the pads on the palm section are spaced apart along lines that correspond generally to the joint lines of the fingers and palm of the person wearing the glove, with the thin, flexible material between the pads forming living hinges between the pads. Thus, finger pads 49, 51 are spaced along the joint lines 27 between the lower and middle sections of the fingers, and finger pads 49 are spaced from upper palm pads 66, 67 along the joint lines 24 between the lower sections of the fingers and the upper part of the palm. Pads 67 and 68 are spaced from pad 66 along the heart line 22, and lower palm pad 69 is spaced from pads 67 and 68 along the head line 21.

The spacing between the pads is such that when the hand is curled about the object such as a bar, as shown in FIG. 7, the thin, flexible material connecting the pads flexes, allowing adjacent portions of the pads to come together and form a substantially continuous gripping surface 71 that matches the contour of the bar. At the same time, the moldable material 72 fills the voids between the fleshy parts of the palm and fingers, thereby providing a firm, solid grip between the hand and the bar, with only the exterior surfaces of the pads actually contacting the bar.

FIG. 8 illustrates an embodiment in which the pads are attached to an additional layer 73 which overlies the palm section of the glove rather than being attached directly to the body of the glove. This embodiment is generally similar to the embodiment of FIG. 3, and like reference numerals designate corresponding elements in the two. The additional layer includes a substantially inelastic leather section 76 at the base of the palm and a thin, stretchable section 77 of a material such as a Lycra® fabric that overlies the rest of the palm. The two sections are joined together by stitching 78, the lower edge portion of the leather section is attached to the lower edge portion of inner layer 38 by stitching 79, and the upper edge portion of the stretchable section is attached to inner layer 39 by stitching 81 just below the bases of the finger stalls. Pads 66-69 are attached to the outer side of outer layer 73 in the same positions they are attached to the stretchable palm section in the embodiment of FIG. 3.

In the embodiment illustrated, outer layer 73 is attached to the body of the glove along the little finger side, but is detached from the lower body along the thumb side except for a short distance near the lower edge of the glove. If desired, the outer layer can be detached from the body of the glove along the little finger side as well. Being detached along at least one side of the glove, the outer layer is free to move relative to the inner layer of the palm section, with minimal friction on the surface of the skin on the palm. It pre-tensions the palm section and expands and contracts as the hand is curled and uncurled, gently drawing the hand toward the curled position to facilitate gripping of the object, which also minimizes excess materials in palm when gripping.

The invention has a number of important features and advantages. The moldable pads conform to the contours of both the hand and the object being gripped, filling the voids or gaps between the fleshy parts of the palm and fingers and providing a firm, solid grip with a substantially continuous gripping surface in contact with object. Since the moldable material is cohesive and does not require a bladder to contain it, the glove can be made relatively easily and inexpensively.

It is apparent from the foregoing that a new and improved glove for use in weightlifting and other activities involving the gripping of an object has been provided. While only certain presently preferred embodiments have been described in detail, as will be apparent to those familiar with the art, certain changes and modifications can be made without departing from the scope of the invention as defined by the following claims.

The invention claimed is:

1. A glove for gripping an object, comprising a palm section, finger stalls extending from the palm section, and pads on the palm section and the finger stalls of malleable, substantially incompressible material that conforms to the contours of the object and a hand wearing the glove and retains its shape without hardening to provide a firm, solid grip between the hand and the object.

2. The glove of claim 1 wherein the palm section and the finger stalls are fabricated at least in part of soft, flexible material.

3. The glove of claim 2 wherein the flexible material in the palm section is a stretchable, elastic material.

4. The glove of claim 1 wherein the malleable, substantially incompressible material is made from calcium salts, petroleum jelly and aliphatic acids.

5. The glove of claim 1 wherein the upper palm sections and the finger stalls are fabricated of thin, flexible material and the pads overlie fleshier parts of the palm and fingers, with gaps between the pads extending along joint lines of the palm and fingers and the flexible material in the gaps providing hinges which flex along the joint lines and allow adjacent ones of the pads to come together to form a substantially continuous gripping surface when the hand and glove are curled about the object.

6. The glove of claim 5 wherein the pads on the finger stalls are positioned to overlie the upper parts of the finger sections just below the joint lines between them when grasping an object, and the pads on the palm section are positioned to overlie portions of the palm just below the joint lines between the palm and the fingers.

7. The glove of claim 1 wherein the malleable, substantially incompressible material in the pads on the finger stalls is enclosed in pockets having upper edges that are rolled and closed.

8. The glove of claim 7 wherein the pockets have front and rear panels which are formed continuously with the rolled edges and fastened together along side and bottom edges of the pockets.

9. The glove of claim 8 wherein the front and rear panels are fastened together along the side and bottom edges by stitching.

10. The glove of claim 1 including additional pads on a lower part of the palm section.

11. The glove of claim 10 wherein the additional pads contain a resilient foam material.

12. The glove of claim 1 wherein the palm section includes an inner layer which fits over the palm of the hand and an outer layer which is attached to the inner layer near the base of the palm section and near the finger stalls, with the pads on the palm section being attached to the outer layer.

13. A glove for gripping an object, comprising a palm section, finger openings along one edge of the palm section, and pads on the palm section, with at least some of the pads containing a malleable, substantially incompressible material that conforms to the contours of the object and a hand wearing the glove and retains its shape without hardening to provide a firm, solid grip between the hand and the object.

14. The glove of claim 13 wherein the malleable, substantially incompressible material is made from calcium salts, petroleum jelly and aliphatic acids.

15. The glove of claim 13 wherein the palm section is fabricated of a thin, stretchable, highly elastic material and the pads overlie fleshier parts of the palm, with gaps between the pads extending along joint lines of the palm and the flexible material in the gaps providing hinges which flex along the joint lines and allow adjacent ones of the pads to come together to form a substantially continuous gripping surface when the hand and glove are curled about the object.

16. The glove of claim 13 wherein the pads on a lower part of the palm section contain a resilient foam material.

17. The glove of claim 13 wherein the palm section includes an inner layer which fits over the palm of the hand and an outer layer which is attached to the inner layer near the base of the palm section and near the finger openings, with the pads on the palm section being attached to the outer layer.

18. A glove for gripping an object, comprising a palm side and a back side, with pads on the palm side containing a cohesive, incompressible, non-oozing material that does not require a liquid-tight bladder for containment and is sufficiently malleable to conform to the contours of the object and a hand wearing the glove to provide a firm, solid grip between the hand and the object.

19. The glove of claim 18 wherein the palm side includes a palm section and finger stalls, and the pads are attached to the palm section and to the finger stalls.

20. The glove of claim 19 wherein the palm section and the finger stalls are fabricated at least in part of thin, flexible material, and the pads overlie fleshier parts of the palm and fingers, with gaps between the pads extending along joint lines of the palm and fingers and the flexible material in the gaps providing hinges which flex along the joint lines and allow adjacent ones of the pads to come together to form a substantially continuous gripping surface when the hand and glove are curled about the object.

21. The glove of claim 19 wherein the palm section includes an inner layer which fits over the palm of the hand and an outer layer which is attached to the inner layer near the base of the palm section and near the finger stalls, with the pads on the palm section being attached to the outer layer.

22. A glove for gripping an object, comprising a palm section, finger stalls extending from the palm section for receiving lower and middle sections of the fingers of a hand wearing the glove, and pads on the finger stalls, the pads having rolled upper edges and being positioned to overlie upper parts of the lower and middle finger sections when the hand wearing the glove is grasping an object.

23. The glove of claim 22 wherein the pads have front and rear panels which are formed continuously with the rolled edges and fastened together along side and bottom edges of the panels.

24. The glove of claim 23 wherein the front and rear panels are fastened together along the side and bottom edges and attached to the finger stalls by stitching.

25. The glove of claim 22 wherein at least some of the rolled edges are formed by extensions of front portions of the finger stalls which are folded down at the tips of the stalls and overlie the front portions just below the tips of the stalls.

26. The glove of claim 22 wherein the pads contain a material that conforms to the contours of the hand and the object to provide a firm, solid grip between the hand and the object.

27. A glove for gripping an object, comprising a palm section, finger stalls extending from the palm section, and pads on the palm section of malleable, substantially incompressible material that conforms to the contours of the object and a hand wearing the glove and retains its shape without hardening to provide a firm, solid grip between the hand and the object.

28. A glove for gripping an object, comprising a palm section, finger stalls extending from the palm section, and pads on the finger stalls of malleable, substantially incompressible material that conforms to the contours of the object and a hand wearing the glove and retains its shape without hardening to provide a firm, solid grip between the hand and the object.

* * * * *